US005262768A

United States Patent [19]

Florer

[11] Patent Number: 5,262,768

[45] Date of Patent: Nov. 16, 1993

[54] RESCUE BEACON APPARATUS

[76] Inventor: Ralph F. Florer, 5255 S. Park Ave., Lot 135, Tucson, Ariz. 85706

[21] Appl. No.: 770,454

[22] Filed: Oct. 3, 1991

[51] Int. Cl.[5] ..... G08B 5/00

[52] U.S. Cl. ..... 340/815.15; 340/473; 362/62; 362/253

[58] Field of Search ..... 340/815.15, 473; 455/97; 362/62, 253; 116/210

[56] References Cited

U.S. PATENT DOCUMENTS

| | | | |
|---|---|---|---|
| 3,181,135 | 2/1962 | Zoglio | 340/815.15 |
| 3,592,157 | 7/1971 | Schwartz | 362/62 |
| 3,593,146 | 7/1971 | Schriewer | 455/97 |
| 3,727,229 | 4/1973 | Clinger et al. | 116/210 |
| 3,745,324 | 7/1973 | Shefler et al. | 362/62 |
| 3,746,285 | 7/1973 | Mango | 116/210 |
| 3,796,181 | 3/1974 | Collins | 116/210 |
| 3,941,079 | 3/1976 | McNeill | 116/210 |
| 3,951,260 | 4/1976 | Frazee | 116/210 |
| 3,964,427 | 6/1976 | Murphy | 116/210 |
| 4,042,882 | 8/1977 | Camacho et al. | 116/210 |
| 4,416,433 | 11/1983 | Bellina | 116/210 |
| 4,772,990 | 9/1988 | Linehan et al. | 340/473 |
| 4,800,835 | 1/1988 | Mears | 116/210 |
| 4,901,664 | 2/1990 | Labrecque | 116/210 |
| 4,944,242 | 7/1990 | Russel | 116/210 |
| 5,075,830 | 12/1991 | Perez | 362/253 |

*Primary Examiner*—Ulysses Weldon
*Assistant Examiner*—M. Fatahiyar
*Attorney, Agent, or Firm*—Leon Gilden

[57] ABSTRACT

An apparatus wherein an anchor housing includes pivotally mounted side and end walls that are released upon manipulation of a cover lid clasp and upon projection of an upper end wall projection into a lower end wall cavity to effect dispensing of a pressurized gas into an associated balloon to project above the anchor housing, with a flasher unit mounted to the balloon medially thereof in operative association with a rechargeable battery and solar panels to effect continuous recharging of the battery. A windlass housing is secured to the individual, with an associated windlass crank arm to effect selective release of a container tether line mounting the anchor housing to the windlass housing.

1 Claim, 6 Drawing Sheets

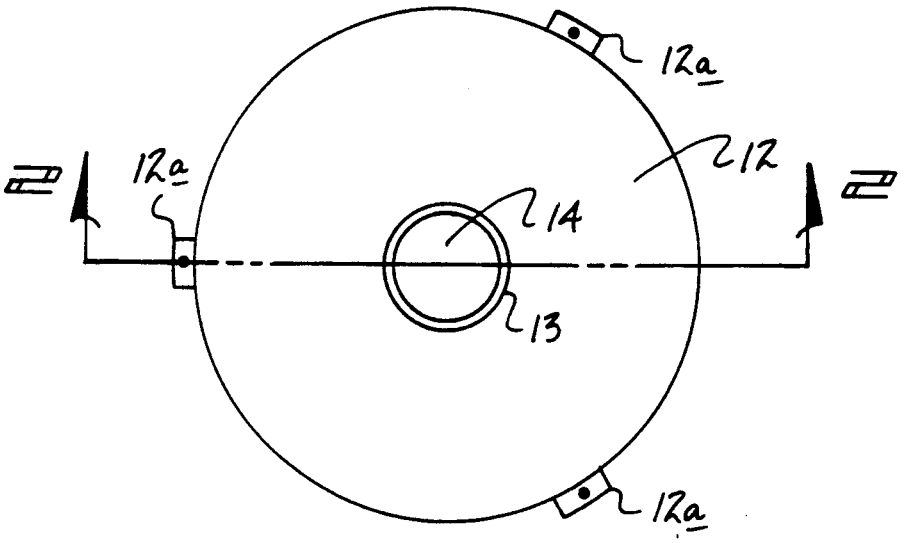
FIG 1
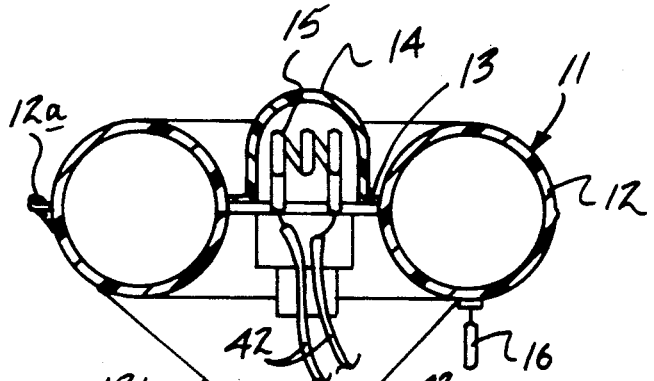
FIG 2
FIG 3
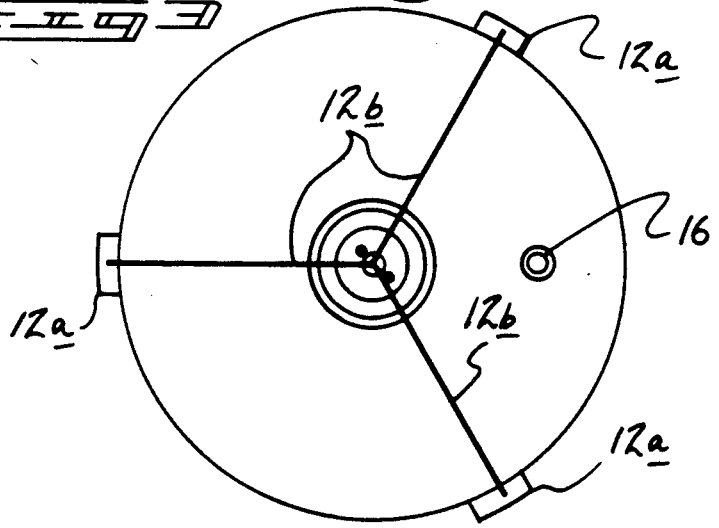

24
17
23
25
19
22
21
33
18
26
28
19a
34
31
21a
32

RESCUE BEACON APPARATUS

BACKGROUND OF THE INVENTION

1. Field of the Invention

The field of invention relates to rescue apparatus, and more particularly pertains to a new and improved rescue beacon apparatus wherein the same is arranged for selective inflation and disposition above an individual requiring assistance.

2. Description of the Prior Art

The prior art has utilized inflatable gas balloons wherein U.S. Pat. No. 4,794,498 to Neumeier sets forth a gas balloon utilizing an illumination member therewithin for use in an advertising situation, wherein a housing mounting a battery container is secured relative to a lower end portion of the balloon.

U.S. Pat. No. 4,901,664 to Labrecque sets forth a survival kit utilizing an inflatable balloon arranged for projection relative to an individual supporting a holder mounting a reel therewithin.

U.S. Pat. No. 4,787,575 to Stewart sets forth a signal balloon mounted relative to a base container that is ground supported and includes a quantity of tether line for securing the balloon relative to the housing.

U.S. Pat. No. 4,944,242 to Russell sets forth a rescue balloon including an inflation cylinder and a tether line for securing the balloon relative to a ground supported container.

As such, it may be appreciated that there continues to be a need for a new and improved rescue beacon apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of rescue apparatus now present in the prior art, the present invention provides an rescue beacon apparatus wherein the same is arranged for the inflation and projection of a balloon relative to a ground support windlass housing. As such, the general purpose of the present invention, which will be described subsequently in greater detail, is to provide a new and improved rescue beacon apparatus which has all the advantages of the prior art rescue apparatus and none of the disadvantages.

To attain this, the present invention provides an apparatus wherein an anchor housing includes pivotally mounted side and end walls that are released upon maniuplation of a cover lid clasp and upon projection of an upper end wall projection into a lower end wall cavity to effect dispensing of a pressurized gas into an associated balloon to project above the anchor housing, with a flasher unit mounted to the balloon medially thereof in operative association with a rechargeable battery and solar panels to effect continuous recharging of the battery. A windlass housing is secured to the individual, with an associated windlass crank arm to effect selective release of a container tether line mounting the anchor housing to the windlass housing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved rescue beacon apparatus which has all the advantages of the prior art rescue apparatus and none of the disadvantages.

It is another object of the present invention to provide a new and improved rescue beacon apparatus which may be easily and efficiently manufactured and marketed.

It is a further object of the present invention to provide a new and improved rescue beacon apparatus which is of a durable and reliable construction.

An even further object of the present invention is to provide a new and improved rescue beacon apparatus which is susceptible of a low cost of manufacture with regard to both materials and labor, and which accordingly is then susceptible of low prices of sale to the consuming public, thereby making such rescue beacon apparatus economically available to the buying public.

Still yet another object of the present invention is to provide a new and improved rescue beacon apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic top view of the signal balloon utilized by the invention.

FIG. 3 is an orthographic bottom view of the signal balloon utilized by the invention.

FIG. 4 is an isometric illustration of the anchor housing utilized by the invention.

FIG. 7 is an orthographic cross-sectional illustration, taken along the lines 7—7 of FIG. 6 in the direction indicated by the arrows.

DESCRIPTION OF THE PREFERRED EMBODIMENT

Figure 2:
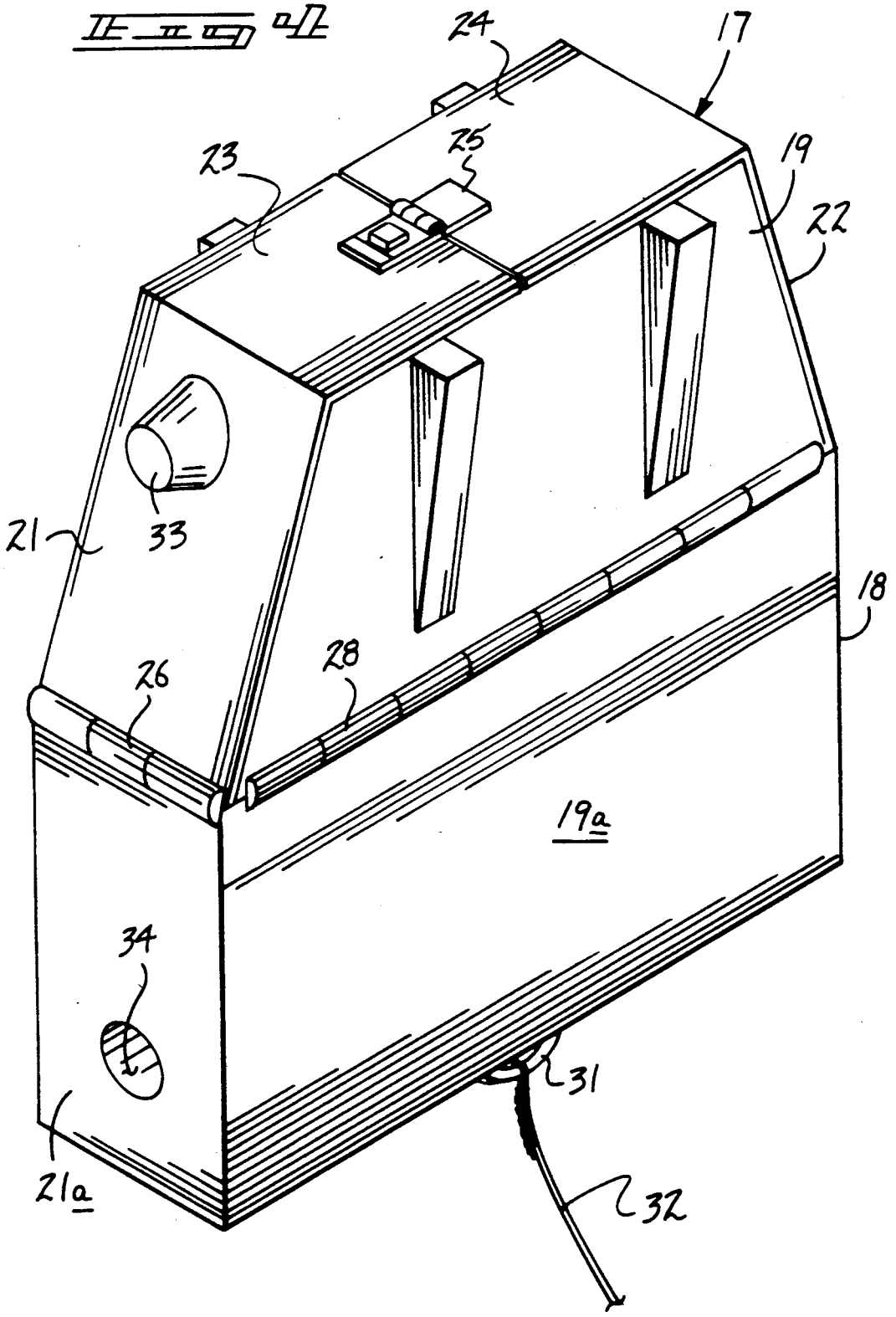
FIG. 2 is an orthographic view, taken along the lines 2—2 of FIG. 1 in the direction indicated by the arrows.

With reference now to the drawings, and in particular to FIGS. 1 to 8 thereof, a new and improved rescue beacon apparatus embodying the principles and concepts of the present invention and generally designated by the reference numeral 10 will be described.

More specifically, the rescue beacon apparatus 10 of the instant invention essentially comprises a signal balloon 11 mounted within an anchor housing 17 (see FIGS. 5 and 6) that in turn is secured to a windlass housing, in a manner to be discussed in more detail below.

The signal balloon 11 includes a torroidal balloon member 12 that includes a plurality of balloon mounting loops circumferentially mounted about a periphery of the balloon 12, with each loop 12*a* including a balloon tether line 12*b*, wherein the tether lines are merged and secured together to the anchor housing 17 relative to a base container partition wall 41 at an upper terminal end thereof, in a manner to be discussed in more detail below (see the FIG. 7 relative to the partition wall 41). A central support plate 13 mounted within a central opening of the balloon member 12 mounts a flasher bulb housing 14 that in turn mounts a flasher bulb 15 therewithin. The flasher bulb 15 is in electrical communication to the anchor housing 17 and a rechargeable battery 45 therewithin through a flasher bulb electrical line 42. Inflation of the balloon member 12 is effected through an inflation gas canister 16, as illustrated in the FIG. 2 and 7.

Figure 6:
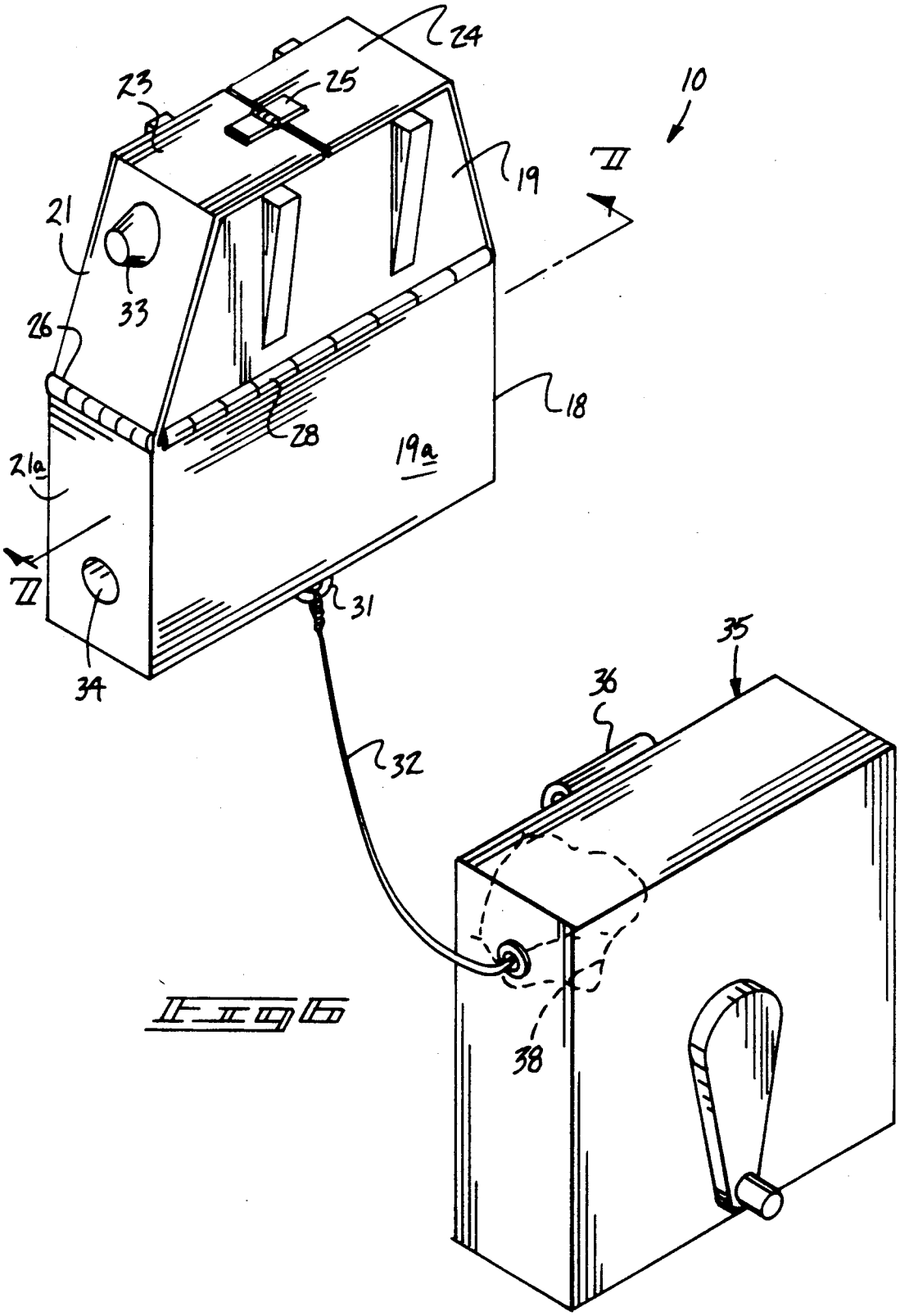
FIG. 6 is an isometric illustration of the anchor housing in association with the windlass housing.
Figure 11:
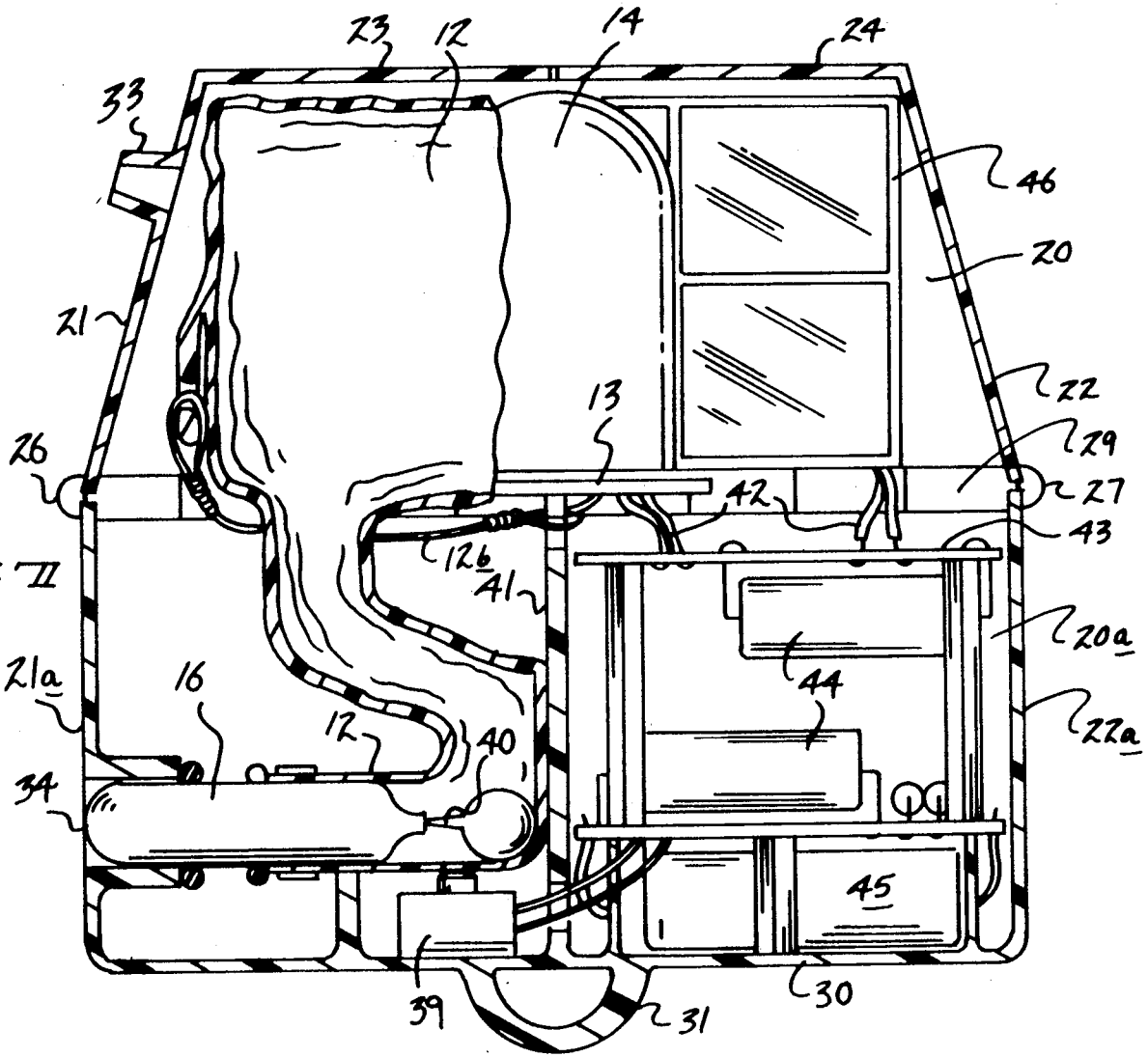

The anchor housing 17 includes a base container 18 defined by a first lower side wall 19*a*, a second lower side wall 20*a*, a first lower end wall 21*a*, and a second lower end wall 22*a*, with the base container 18 walls fixedly mounted to a base container floor 30. Hingedly mounted relative to each wall of the base container is a respective first upper side wall 19 hingedly mounted about a first side wall hinge 28, a second upper side wall 20 hingedly mounted about a second side wall hinge 29, a first upper end wall 21 hingedly about a first end wall hinge 26, and a second upper end wall 22 hingedly mounted about a second end wall hinge 27. Each hinge is arranged in a coplanar relationship relative to one another, wherein the first and second end wall hinges 26 and 27 are arranged parallel relative to one another, with the first and second side wall hinges 28 and 29 arranged parallel relative to one another and orthogonally oriented relative to the end wall hinges 26 and 27. The first upper end wall 21 includes a first end wall cover lid 23, with the second upper end wall 22 including a second upper end wall lid 24, wherein the end wall lids are fixedly joined to the first and second upper end walls 21 and 22 and extend between the first and second upper side walls 19 and 20 when the anchor housing 17 is in a first closed configuration, as illustrated in FIG. 6 for example. A cover lid clasp 27 mounted to the first and second end wall cover lids 23 and 24 is arranged for selective release of the cover lids 23 and 24. Upon release of the clasp 25, an upper end wall projection 33 spaced from the first end wall hinge 26 a predetermined spacing is receivable within a lower end wall cylindrical cavity 34 spaced below the hinge 26 at an equal spacing to receive the projection 33 therewithin. Reference to FIG. 7 illustrates the lower end wall cylindrical cavity 34 slidably mounting the inflation gas canister 16 therewithin, whereupon projection of the canister 16 interiorly of the base container 18 directs the canister 16 into the piercing rod 40 mounted to the base container partition wall 41 to effect release of pressurized gas contained within the canister 16 to direct such gas into the balloon member 12.

Figure 5:
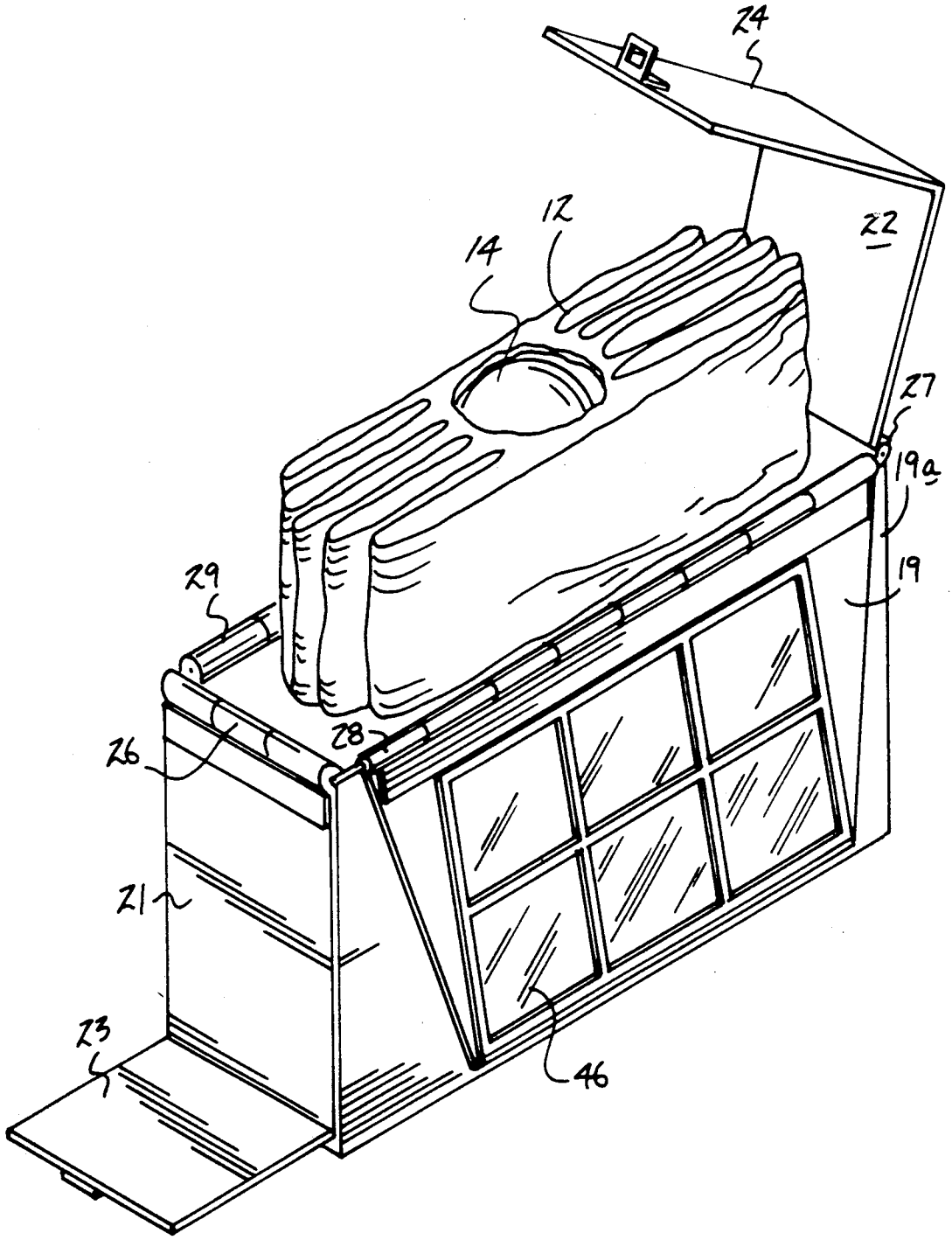
FIG. 5 is an isometric illustration of the anchor housing in a partially opened configuration.

Accordingly, when the upper side and end walls 19–22 respectively are arranged in an opened configuration, such as illustrated in FIG. 5, and the projection 33 is directed within the cylindrical cavity 34, release of the balloon 12 is arranged and upon release of the balloon from within the base container 18, release of contiguous communication of a normally opened switch 39 is effected that is normally in contiguous communication with the balloon 12, whereupon through the flasher units 44 and an associated circuit control panel 43, the flasher bulb 15 is directed to effect a flashing operative through a rechargeable battery 45 that in turn is recharged through solar panels 46 mounted to interior surfaces of the first and second upper side walls 19 and 20.

Figure 8:
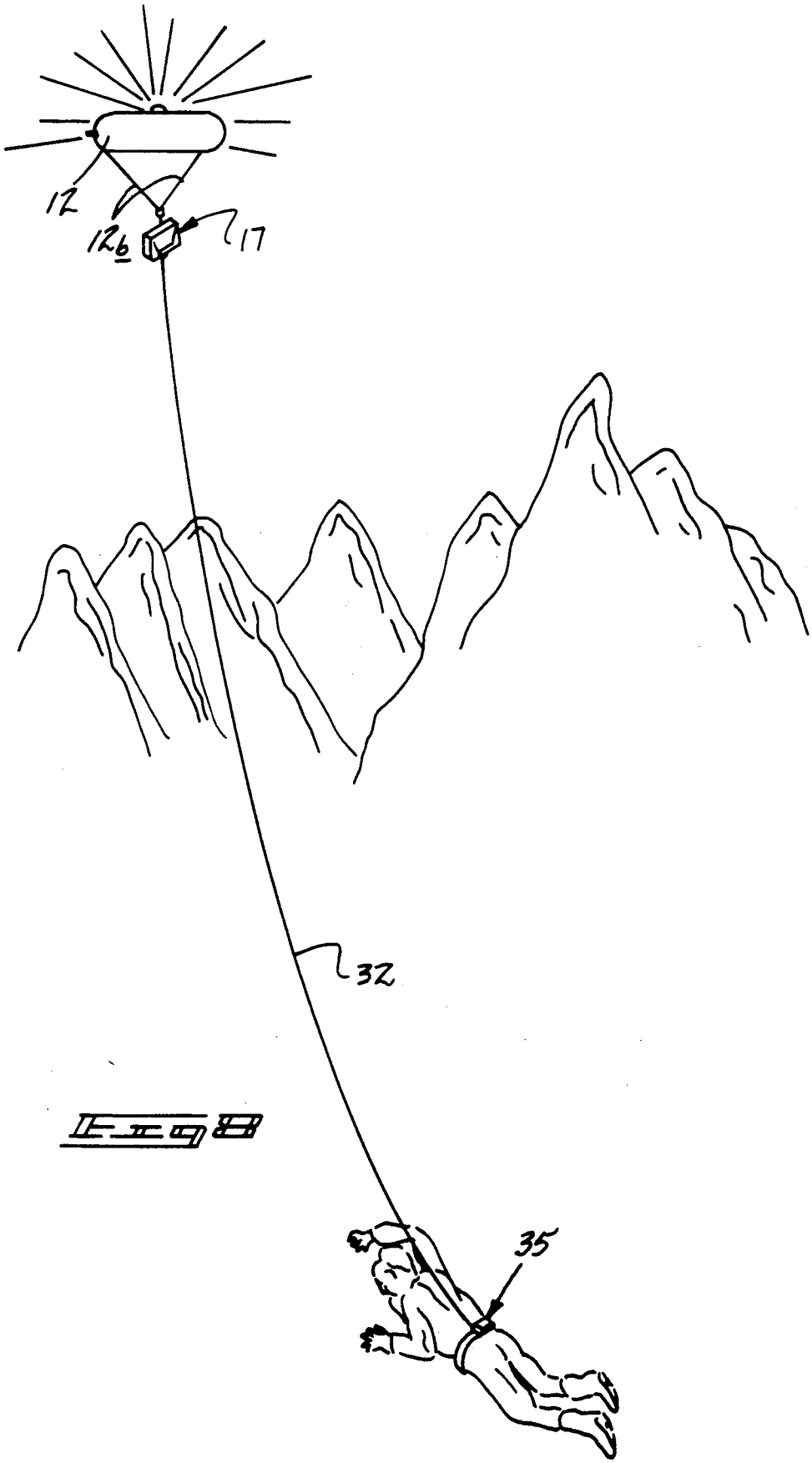
FIG. 8 is an isometric illustration of the invention in use.

The container tether line 32 mounted to a base container floor mounting loop 31 mounted to a bottom surface of the base container floor 30 is received within the windlass housing 35 directed about a winding reel 38 that is arranged for rotation by a crank arm 37 that projects through a front wall of the windlass housing, wherein a belt clip 36 mounted to a rear wall of the windlass housing is arranged for securement of the windlass housing to an individual, in a manner as illustrated in FIG. 8.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A rescue beacon apparatus, comprising in combination, a signal balloon, the signal balloon including a central support plate, and the central support plate mounting fixedly a flasher bulb housing thereon, wherein the flasher bulb housing includes a flasher bulb therewithin, and an anchor housing arranged in a first closed configuration to contain the signal balloon therewithin, wherein the anchor housing is opened to a second configuration from the first configuration to effect release of the signal balloon, and the anchor housing including a container tether line, wherein the tether line includes a first distal end secured to the anchor housing, and the container tether line includes a second distal end, and a windlass housing, the container tether line second distal end mounted to the windlass housing, and wherein the windlass housing includes a windlass housing rear wall and windlass housing forward wall, the windlass housing rear wall includes a clip member mounted thereon for securement of the windlass housing to an individual, and wherein the windlass housing forward wall includes a crank arm rotatably directed through the windlass housing forward wall, and a winding reel rotatably mounted within the windlass housing, wherein the crank arm is arranged for rotation of the winding reel, and wherein the container tether line is directed through the windlass housing and wound about the winding reel to effect selective winding and reeling of the container tether line about the winding reel, and the signal balloon includes a torroidal balloon member formed with a central opening, the central support plate mounted within the central opening, and the signal balloon including a plurality of balloon mounting loops circumferentially mounted about a periphery of the balloon member, and each of the mounting loops including a tether line, and each tether line joined to the anchor housing interiorly of the anchor housing, and the anchor housing includes a rigid base container, the rigid base container including a base container floor, and the base container floor including a mounting loop, wherein the mounting loop is arranged for securement of the container tether line forward distal end, and the base container floor including a first lower side wall and a second lower side wall, and a first lower end wall and a second lower end wall to define the base container, and the first lower side wall including a first upper side wall hingedly mounted to the first lower side wall about a first side wall hinge, and the second lower side wall including a second upper side wall hingedly mounted to the second lower side wall about a second side wall hinge, and the first lower end wall including a first end wall hinge hingedly mounting the first lower end wall to the first upper end wall, and the second lower end wall including a second upper end wall hingedly mounted to the lower end wall about a second end wall hinge, wherein each hinge is arranged in a coplanar relationship relative to one another, and wherein the first end wall hinge and the second end wall hinge are arranged parallel relative to one another, and the first side wall hinge and the second side wall hinge are arranged parallel relative to one another, and the first upper end wall includes a first end wall cover lid obliquely and fixedly mounted to the first upper end wall, and the second upper end wall includes a second end wall cover lid obliquely and fixedly mounted to the second upper end wall, and the first end wall cover lid and the second end wall cover lid are positioned between the first upper side wall and the second upper side wall in the first configuration, and wherein the first end wall cover lid and the second end wall cover lid include a cover lid clasp to effect securement of the first end wall cover lid and the second end wall cover lid together maintaining the anchor housing in the first configuration, whereupon release of the first end wall cover lid relative to the second end wall cover lid by release of the cover lid clasp permits maintaining of the anchor housing to the second configuration, and the first upper end wall includes an upper end wall projection spaced from the first end wall hinge a predetermined spacing, and the first lower end wall includes a lower end wall cylindrical cavity spaced below the first end wall hinge a further spacing equal to the predetermined spacing, and the first upper end wall projection is receivable within the lower end wall cylindrical cavity upon opening of the anchor housing to the second configuration, and the signal balloon includes an inflation gas canister mounted to the torroidal balloon member, wherein the torroidal balloon member and the inflation gas canister are positioned within the anchor housing in the first configuration, and the inflation gas canister is slidably mounted within the lower end wall cylindrical cavity, and a piercing rod fixedly mounted within the inflation gas canister coaxially aligned with a forward terminal end of the inflation gas canister, whereupon projection of the upper end wall projection into the lower end wall cylindrical cavity permits communication with the upper end wall projection with a rear terminal end of the inflation gas canister and permits projection and piercing of the gas canister by the piercing rod, and the anchor housing includes a base container partition wall mounted within the base container and spaced from the first lower end wall fixedly mounting the piercing rod, and an upper terminal end of the partition wall is arranged for securement of each balloon tether line, and a circuit control panel mounted within the base container, and a flasher unit mounted within the base container and a rechargeable battery mounted within the base container, wherein the battery, the flasher unit, and the circuit control panel are in electrical communication with the flasher bulb to effect selective flashing of the flasher bulb, and a normally opened switch in contiguous communication with the balloon member in the first configuration, whereupon release of the balloon member relative to the base container in the second configuration effects closing of the switch to direct electrical energy to the flasher bulb, and at least one solar panel mounted to an interior surface of each upper side wall, wherein each solar panel is in communication with the rechargeable battery to provide for recharging of the battery upon opening of the anchor housing to the second configuration.

* * * * *